US006101965A

United States Patent [19]

Koyanagi

[11] Patent Number: 6,101,965

[45] Date of Patent: Aug. 15, 2000

[54] RIDE PLATE FOR WATERCRAFT

[75] Inventor: Tomoyoshi Koyanagi, Shizuoka, Japan

[73] Assignee: Yamaha Hadsudoki Kabushiki Kaisha, Shizuoka, Japan

[21] Appl. No.: 08/924,927

[22] Filed: Sep. 8, 1997

[30] Foreign Application Priority Data

Sep. 6, 1996 [JP] Japan ..... 8-257723
Oct. 17, 1996 [JP] Japan ..... 8-297491

[51] Int. Cl.[7] ..... B63B 1/32; B63B 3/00; B63C 7/00

[52] U.S. Cl. ..... 114/288; 114/355; 114/55.5

[58] Field of Search ..... 114/355, 288, 114/61.32, 55.5; 440/2, 38; D12/317, 307

[56] References Cited

U.S. PATENT DOCUMENTS

Re. 34,922 5/1995 Hattori et al. .
D. 317,431 6/1991 Klus .
D. 335,484 5/1993 Moyle et al. ..... D12/317
D. 378,813 4/1997 Jacques .
D. 392,936 3/1998 Koyanagi ..... D12/317
4,925,408 5/1990 Webb et al. ..... 440/38
4,932,347 6/1990 Mardikian ..... 114/56
5,094,182 3/1992 Simner ..... 114/163
5,433,635 7/1995 Kobayashi ..... 440/2

*Primary Examiner*—S. Joseph Morano
*Assistant Examiner*—Patrick Craig Muldoon
*Attorney, Agent, or Firm*—Knobbe, Martens, Olson & Bear LLP

[57] ABSTRACT

A watercraft is disclosed including an improved ride plate for enhanced handling, responsiveness and performance of the watercraft. The ride plate preferably has two grooves formed in the undersurface of the ride plate. The grooves are of continuous cross section, extend the entire length of the ride plate and are located behind the water intake duct opening. Finally, the grooves are strategically located to avoid the turbulent water caused by the water entering the water intake opening so as to increase the handling, responsiveness and performance of the watercraft.

22 Claims, 14 Drawing Sheets

RIDE PLATE FOR WATERCRAFT

BACKGROUND OF THE INVENTION

1. Field of the Invention

The present invention relates to a watercraft with an improved hull surface, and more particularly, to a hull undersurface with an improved ride plate for enhancing the performance and maneuverability of the watercraft.

2. Description of Related Art

Personal watercraft have become very popular in recent years. An enthusiasm for competition has grown with this popularity, and as a result, personal watercraft have become increasingly faster. Many personal watercraft today are capable of traveling at speeds above 60 mph. At such speeds, however, some watercraft, especially those with modified engines, tend not to provide the stability that many riders prefer. High-performance personal watercraft also tend not to respond in a manner that many riders desire.

To improve the stability, maneuverability and the handling characteristics of the watercraft at high speeds, many personal watercraft now include chines or strakes in the under surface of the hull. A strake is an elongated rib attached to a side of the personal watercraft hull. Personal watercraft generally include a several strakes which are positioned on opposite sides of the watercraft at the same position and in the same angular orientation relative to a center longitudinal line of the watercraft hull. Some strakes are integrally formed with the hull when the watercraft hull is molded. Other strakes are fixed to the hull by conventional fasteners, (e.g., screws).

The strakes improve the handling characteristics of the personal watercraft. The strakes counteract the rider's shifted weight when turning, thereby allowing the rider to lean into a turn. By positioning the strakes at points on the hull sides which lie below the water line when the watercraft is turning, the turning or handling characteristics of the watercraft also become more aggressive; a low position of the strakes on the hull sides makes the watercraft more responsive.

SUMMARY OF THE INVENTION

When the watercraft is up on plane, however, the effect of the strakes is limited to the actual exposure of the strakes to the water. Thus, if the rider is conducting an aggressive turn, the watercraft will be angled to one side and the strakes will engage with the water. If the rider is not making an aggressive turn, the only portion of the strakes will not contact the water and therefore not aid in the handling of the watercraft.

In accordance with the present invention, there is provided an improved ride plate. The ride plate of the present invention advantageously enhances the handling and performance of the watercraft.

These and other features are accomplished by providing a watercraft with a hull with an undersurface that defines a tunnel at the rear end. The hull has a longitudinal axis extending in a forward direction toward a bow of the watercraft and in a rearward direction toward a stem of the watercraft. The watercraft also comprises a jet propulsion unit positioned at least partly within the tunnel for propelling the watercraft. The jet propulsion unit has a discharge nozzle formed at the rear end thereof through which water is discharged for propelling the watercraft. The watercraft also includes a ride plate attached to the underside of the hull located at least partially beneath the jet propulsion unit. The ride plate further comprises at least one continuous groove.

The groove extends from the forward most portion of the ride plate to the rearward most portion of the ride plate. The groove is formed on the underside of the ride plate.

Another embodiment of the present invention also includes a watercraft with a hull with an undersurface defining a tunnel at the rear end thereof. The undersurface of the hull includes a longitudinal axis located at the center of the undersurface of the hull. The longitudinal axis extends in a forward direction toward a bow of the watercraft and in a rearward direction toward a stem of the watercraft. The watercraft also includes a water intake duct communicating with a jet propulsion unit. The water intake duct includes an intake duct opening for water to enter the water intake duct. The intake duct opening is located forward of the ride plate. The jet propulsion unit is positioned at least in part within said tunnel for propelling said watercraft. The jet propulsion unit has a discharge nozzle formed at the rear end thereof through which water is discharged for propelling said watercraft. The ride plate is attached to the underside of the hull and is located at least partially beneath the jet propulsion unit. The ride plate further comprises at least two grooves formed on the underside of said ride plate. Each of the grooves comprises at least two lateral edges with at least one of the edges being located on the ride plate at a distance farther from the longitudinal axis than an adjacent edge of the intake duct opening in a laterally outward direction from the longitudinal axis.

Another embodiment of the invention comprises a watercraft with a hull with an undersurface defining a tunnel at the rear end thereof. The undersurface of the hull includes a water intake duct opening for water to enter a water intake duct. The water intake duct communicates with a jet propulsion unit positioned at least in part within the tunnel for propelling the watercraft. The jet propulsion unit has a discharge nozzle formed at the rear end thereof through which water is discharged for propelling the watercraft. A ride plate is attached to the underside of the hull and is located at least partially beneath the jet propulsion unit. The ride plate further comprises watercraft performance enhancement means for improving the performance of the watercraft.

Yet another embodiment of the invention comprises a ride plate for a watercraft. The ride plate comprises a front end and a rear end and at least one continuous groove extending from the front end of the ride plate to the rear end of the ride plate. The groove is formed on the lower side of the ride plate. The groove comprises at least two opposing edges. The ride plate also contains at least one boss configured to cooperate with a portion of a hull undersurface of the watercraft to mounting said ride plate to said watercraft.

Further aspects, features, and advantages of the present invention will become apparent from the detailed description of the preferred embodiments which follows.

BRIEF DESCRIPTION OF THE DRAWINGS

The above-mentioned and other features of the invention will now be described with reference to the drawings of a preferred embodiment of the present watercraft. The illustrated embodiment is intended to illustrate, but not to limit the invention. The drawings contain the following figures.

DETAILED DESCRIPTION OF PREFERRED EMBODIMENT

Figure 1:
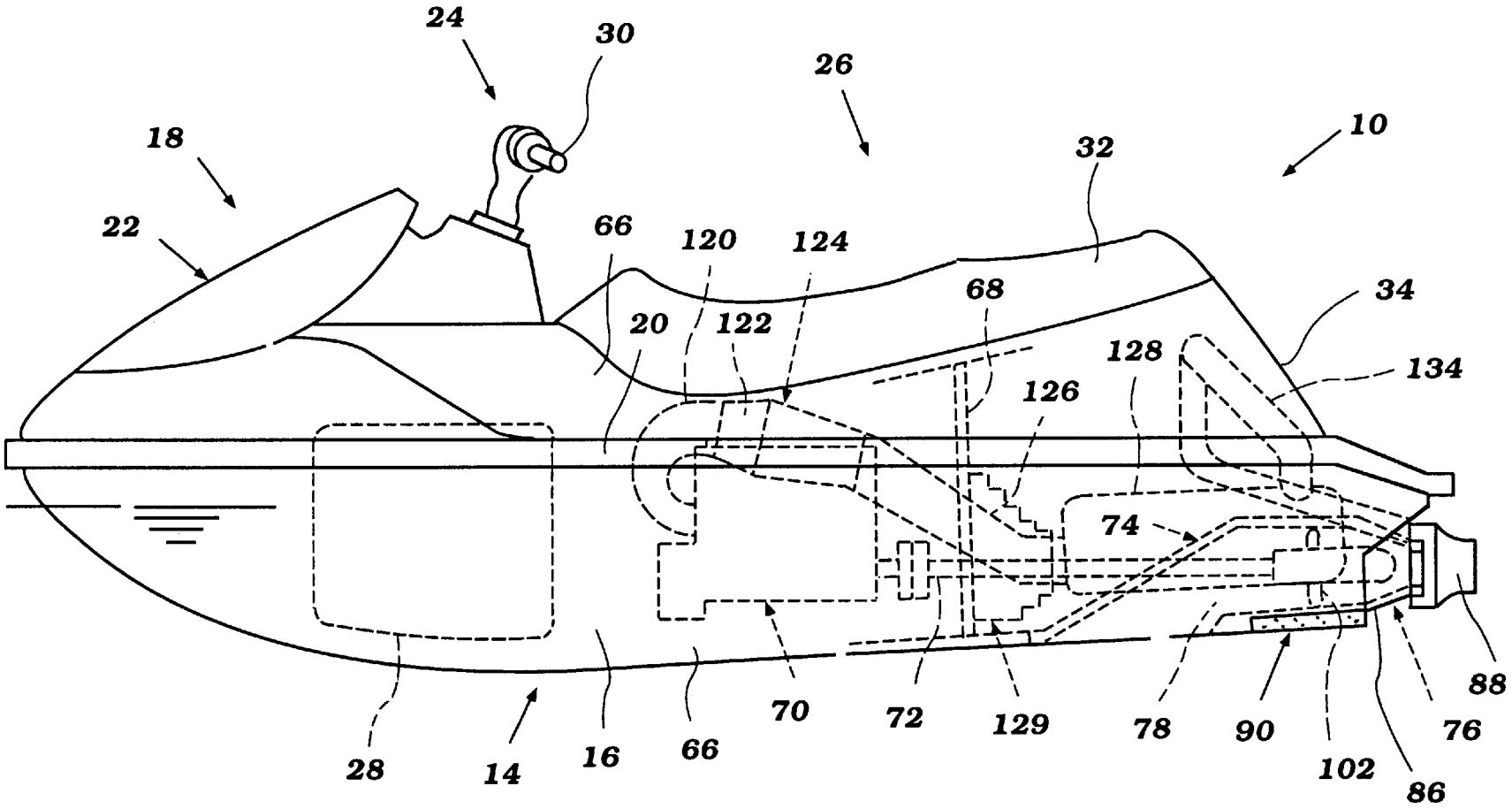
FIG. 1 is a side elevational view of a personal watercraft configured in accordance with a preferred embodiment of the present invention, and illustrates several internal components of the watercraft in phantom.
Figure 2:
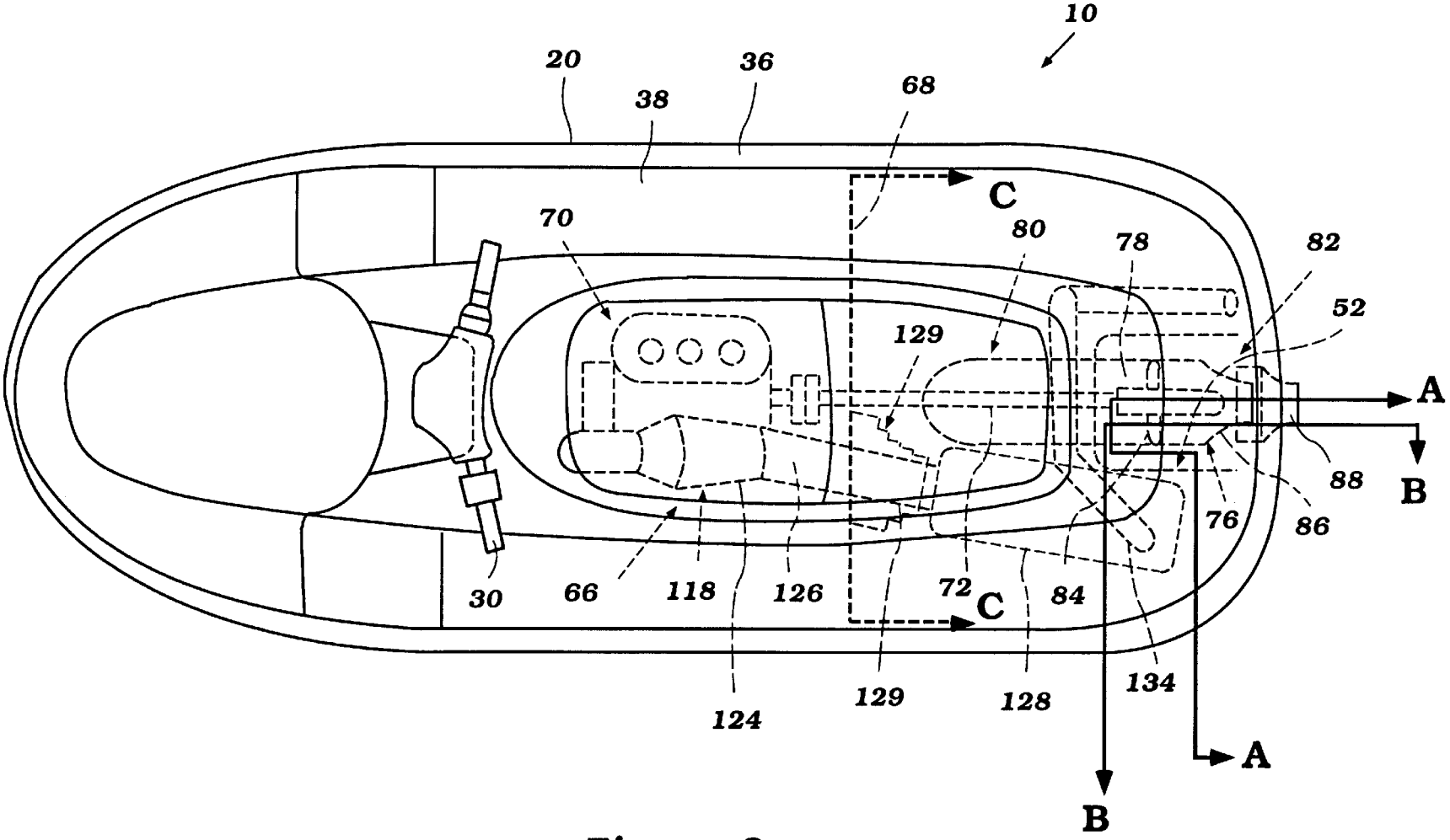
FIG. 2 is a top plan view of the personal watercraft of FIG. 1 with several internal components of the watercraft illustrated in phantom.

FIGS. 1 and 2 illustrate a watercraft incorporating a ride plate in accordance with a preferred embodiment of the present invention. The present ride plate has particular utility for a personal watercraft, and therefore is illustrated in connection with such a vehicle. It is contemplated, however, that the present improved ride plate can be used with other types of vehicles as well, such as, for example, but without limitation, small boats and the like.

With initial reference to FIGS. 1 and 2, the watercraft 10 includes a hull 14 formed by a lower hull section 16 and an upper deck section 18. The hull sections 16, 18 are formed from a suitable material such as, for example, a molded fiberglass reinforced resin or sheet molding compound (SMC). The lower hull section 16 and the upper deck section 18 are fixed to each other around the peripheral edges 20 in any suitable manner.

As viewed in the direction from the bow to the stem of the watercraft, the upper deck section 18 includes a bow portion 22, a control mast 24 and a rider's area 26. The bow portion 22 slopes upwardly toward the control mast 24 and includes at least one air duct, not shown, through which air can enter the hull 14. A lid or cover, also not shown, desirably extends above an upper end of the air duct to inhibit an influx of water into the hull 14.

As seen in FIG. 1, a fuel tank 28 is located within the hull 14 beneath the cover. Conventional means, such as, for example, straps, secure the fuel tank to the lower hull 16. A fuel filler hose extends between a fuel cap assembly and the fuel tank. In the illustrated embodiment, the filler cap assembly is secured to the bow portion 22 of the hull upper deck 18 to the side and in front of the control mast 24. In this manner, the fuel tank can be filled from outside the hull 14 with the fuel passing through the fuel filler hose into the tank.

The control mast 24 extends upward from the bow portion 22 and supports a handlebar assembly 30. The handlebar 30 controls the steering of the watercraft 10 in a conventional manner. The handlebar assembly 30 also carries a variety of controls of the watercraft 10, such as, for example, a throttle control, a start switch and a lanyard switch.

With reference to FIGS. 1 and 2, the rider's area 26 lies behind the control mast 24 and includes a seat assembly 32. In the illustrated embodiment, the seat assembly 32 has a longitudinally extending straddle-type shape that may be straddled by an operator and by at least one or two passengers. The seat assembly 32, at least in principal part, is formed by a seat cushion supported by a raised pedestal 34. The raised pedestal 34 has an elongated shape and extends longitudinally along the center of the watercraft 10. The seat cushion is desirably removably attached to a top surface of the pedestal 34 and covers the entire upper end of the pedestal 34 for rider and passenger comfort.

The upper deck section 18 of the hull 14 advantageously includes a pair of raised gunnels 36 (FIG. 2) positioned on opposite sides of the aft end of the upper deck assembly 18. The raised gunnels 36 define a pair of foot areas 38 that extend generally longitudinally and parallel to the sides of the pedestal 34. In this position, the operator and any passengers sitting on the seat assembly 32 can place their feet in the foot areas 38 with the raised gunnels 36 shielding their feet and lower legs. A non-slip (e.g., rubber) mat desirably covers the foot areas 38 to provide increased grip and traction for the operator and the passengers.

With reference to FIGS. 1, 2, 12, 13 and 14, the lower hull 16 is designed such that the watercraft 10 planes or rides on a minimum surface area at the stem end of the lower hull 16 in order to optimize the speed and handling of the watercraft 10 when up on plane. For this purpose, the lower hull section generally has a V-shaped configuration formed by a pair of inclined sections that extend outwardly from a keel line of the hull to the hull's side walls at a dead rise angle.

The inclined sections also extend longitudinally from the bow toward the transom of the lower hull 16. The side walls are generally flat and straight near the stem of the lower hull and smoothly blend towards the longitudinal center of the watercraft at the bow. The lines of intersection between the inclined section and the corresponding side wall form the outer chines 40 of the lower hull section 16. The chines 40 provide the watercraft 10 with directional stability during maneuvering by providing a surface for the watercraft 10 to react against during the turning of the watercraft 10.

The lower hull also includes strakes 42 running substantially parallel to the longitudinal axis of the lower hull 16. The strakes 42 can either be molded into the hull or can be attached to the lower hull with fastening means as known in the art. The purpose of the strakes 42 is similar to that of the chines 40 in that the strakes 42 provide a reaction surface for the watercraft 10 to react against when the watercraft 10 is turning. By locating the strakes 42 close to the longitudinal center of the hull 14, the watercraft 10 will have reaction surfaces for the lower hull 16 to contact the water even when the rider of the watercraft 10 leans into the turn, thus changing the attitude of the lower hull 16 with respect to the water surface.

Toward the bow of the watercraft 10, the lower hull 16 is further divided into a frontal lower bow section 44. The frontal lower bow section 44 extends slightly forward of the lower hull section 16 and is contoured to prevent drag on the hull surface when maneuvering the watercraft 10. The frontal lower hull section 44 intersects the lower hull section 16 at the splash guard 46. When the watercraft 10 is up on plane, the splash guard 46 will be above the water. When the watercraft 10 is operated in choppy water, however, the frontal lower bow section 44 and the splash guard 46 will dive into the water. This will cause the water to splash up the front and sides of the lower hull 16 until the water is diverted from the hull by the splash guard 46 and thus away from the driver or passengers.

Figure 3:
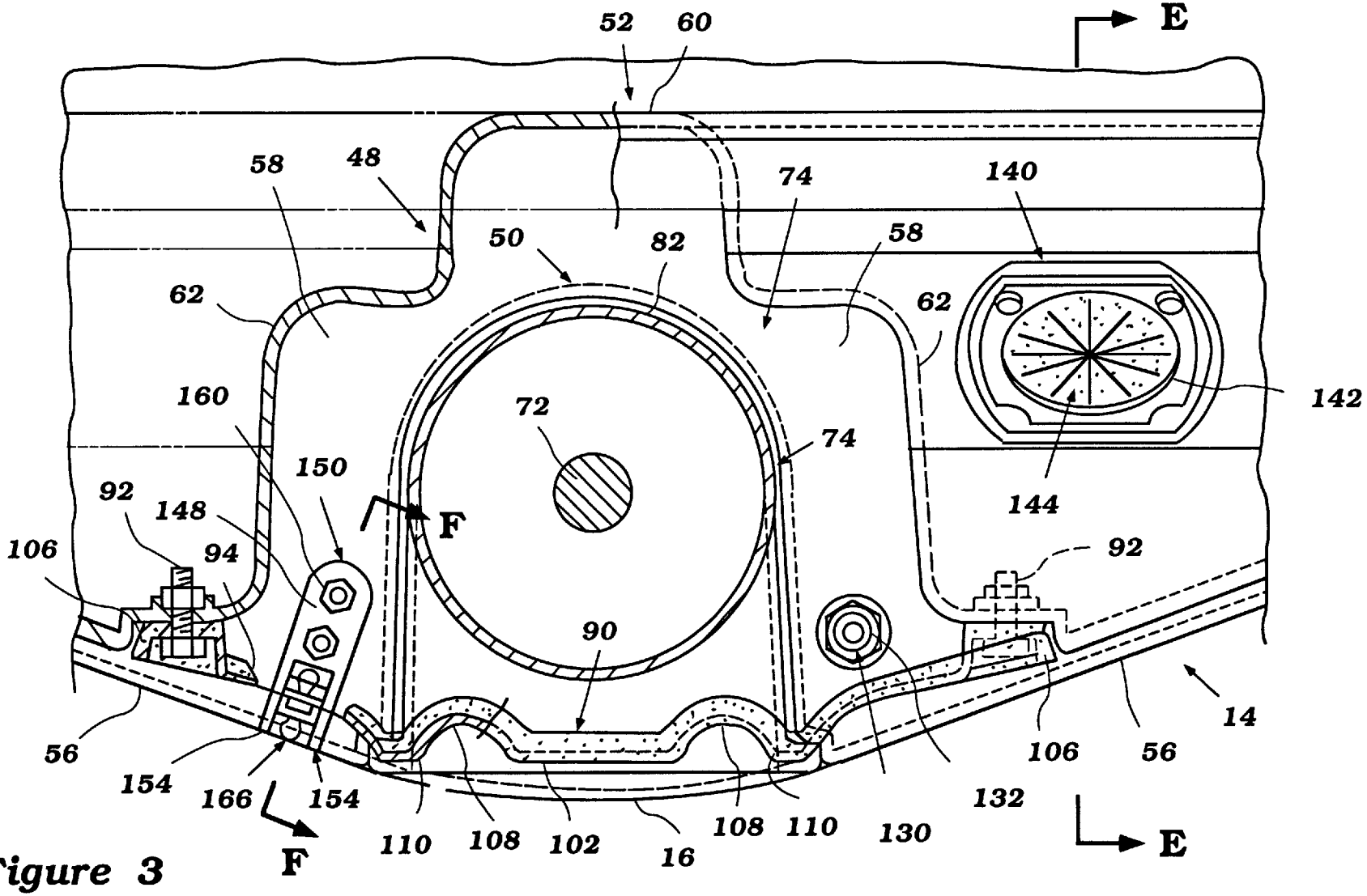
FIG. 3 is a partial cross-sectional view of the personal watercraft of FIG. 2, taken along the line A—A.
Figure 4:
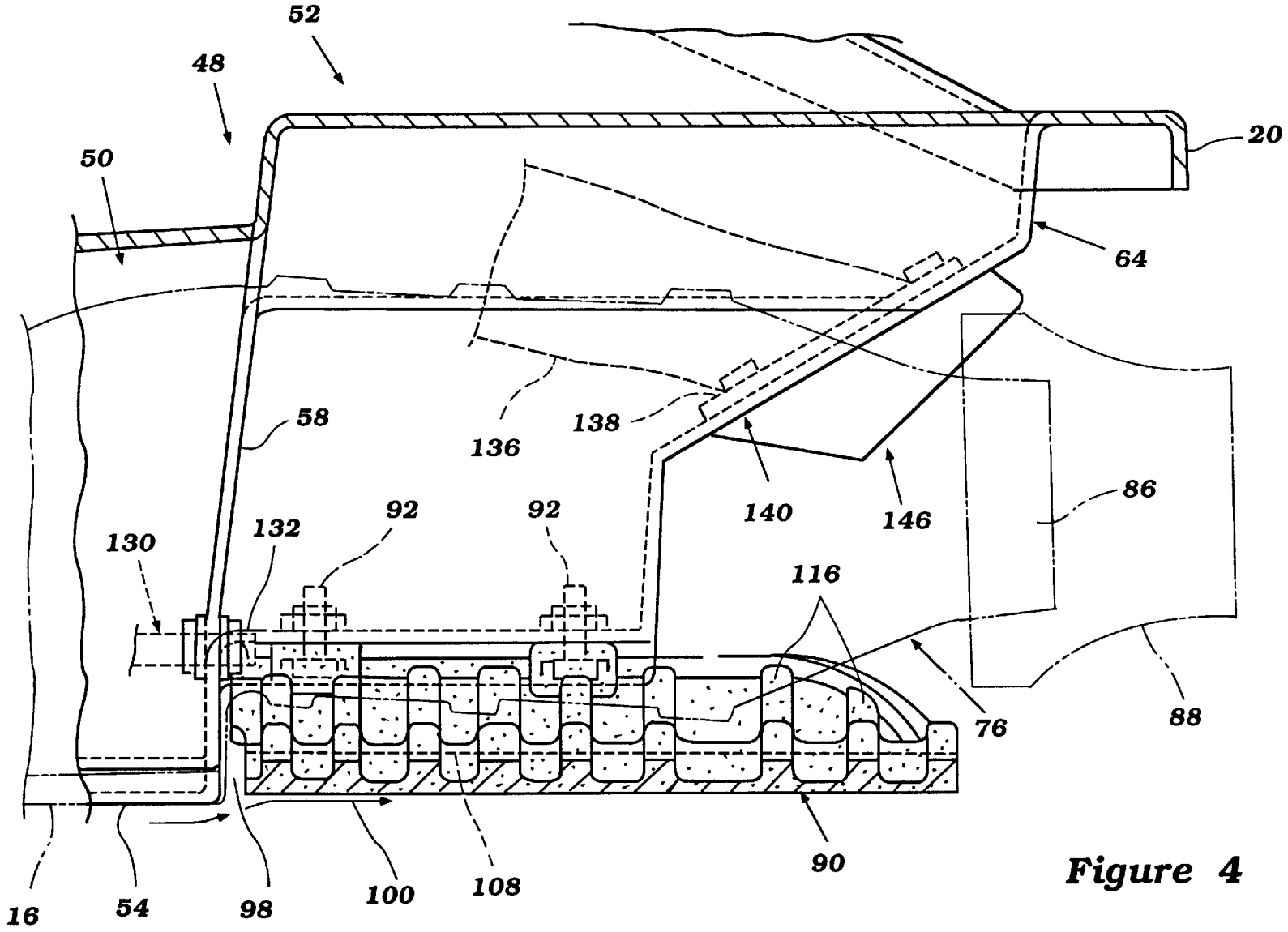
FIG. 4 is a partial cross-sectional view of the personal watercraft of FIG. 2 taken along the line B—B with several internal components of the watercraft illustrated in phantom.

Referring to FIG. 3 and FIG. 4, incline sections of the lower hull 16 extend outwardly from a recessed channel or tunnel, generally referred to as 48, which extends upward toward the upper deck portion 18. The tunnel 48 includes a narrow fore section 50 and a wider aft section 52. The lower hull 16 also forms a step 54 at the transition between the tunnel sections. As best understood from FIG. 3, the step 54 is formed between lower inclined fore section 56 of the lower hull and higher aft inclined sections of lower hull 16.

The tunnel fore section 50 generally has a parallelepiped shape that extends through a front wall 58 of the tunnel aft section 52. The tunnel aft section 52 has a tiered shape, as best seen in FIG. 3, which is principally formed by a ceiling portion 60 of the tunnel aft section 52. The aft section 52 in general is formed by the front wall 58, the ceiling 60 and opposing side walls 62. The aft tunnel 52 extends from the front wall 58 and opens through the rear of the transom 64 of the watercraft 10. The front wall 58 includes an opening into the fore section of the tunnel 50. The lower edges of the front wall 58 and opposing side walls 62 define a lower opening of the aft tunnel 52.

The lower hull portion 16 principally defines the engine compartment 66 in front of a bulkhead 68 (FIG. 2). Except for the air ducts, not shown, the engine compartment 66 is normally substantially sealed so as to enclose an engine 70 of the watercraft 10 from the body of water in which the watercraft 10 is operated.

The internal combustion engine 70 powers the watercraft 10. The engine 70 is positioned within the engine compartment 66 and is mounted centrally within the hull 14. Vibration-absorbing engine mounts secure the engine 70 to the lower hull portion 16 in a known manner.

In the illustrated embodiment, the engine 70 includes a plurality of in-line cylinders and operates on a two-stroke, crankcase compression principle. The engine 70 is positioned such that the row of cylinders lies parallel to a longitudinal axis of the watercraft 10, running from bow to stern. This engine type, however, is merely exemplary. Those skilled in the art will readily appreciate that the present fuel delivery system can be used with any of a variety of engine types having other number of cylinders, having other cylinder arrangements and operating on other combustion principles (e.g., four-stroke principle).

A cylinder block and a cylinder head assembly desirably form the cylinders of the engine. A piston reciprocates within each cylinder of the engine and together the pistons drive an output shaft, such as a crankshaft, in a known manner. A connecting rod links the corresponding piston to the crankshaft. The corresponding cylinder bore, piston and cylinder head of each cylinder forms a variable-volume chamber, which at a minimum volume defines a combustion chamber.

The crankshaft desirably is journalled with a crankcase, which in the illustrated embodiment is formed between a crankcase member and a lower end of the cylinder block. Individual crankcase chambers of the engine are formed within the crankcase by dividing walls and sealing disks, and are sealed from one another with each crankcase chamber communicating with a dedicated variable-volume chamber. Each crankcase chamber also communicates with a charge former of an induction system through a check valve (e.g., a reed-type valve). The induction system receives fuel from a fuel tank 28, which is positioned within the hull 14, and produces the fuel charge which is delivered to the cylinders in a known manner.

An oil tank, not shown, is also located forward of the engine 70. A suitable oil delivery system (e.g., injection system) supplies oil from the tank to the engine in a known manner. Because the internal details of the engine 70, the fuel supply system and the induction system desirably are conventional, a further description of the engine construction is not believed necessary to understand and practice the invention.

As seen in FIG. 1, a coupling interconnects the engine crankshaft to an impeller shaft 72. A bearing assembly (not shown), which is secured to the bulkhead 68, supports the impeller shaft 72 behind the shaft coupling.

The impeller shaft 72 drives a propulsion device 74 of the watercraft 10. In the illustrated embodiment, a jet propulsion unit 76 propels the watercraft 10. A portion of the jet propulsion unit 76 is mounted within the tunnel 48 formed on the underside of the lower hull section 16 by a plurality of bolts. A water intake duct 78 of the jet propulsion unit 76 extends through the opening on the front wall 58 of the tunnel and extends into the fore section of the tunnel 50. The intake duct 78 at its front lower end defines a water intake duct opening 80 that opens into the intake duct 78. The water intake duct 78 can be molded integrally with the lower hull 16 or formed as a separate piece and attached to the lower hull with fasteners known in the art.

The intake duct 78 leads to an impeller housing assembly 82 in which an impeller 84 of the jet propulsion unit 76 operates. The impeller housing assembly 82 also acts as a pressurization chamber and delivers the water flow from the impeller housing 82 to a discharge nozzle housing 86. The impeller housing and the pressurization chamber 82 are located within the larger aft section 52 of the tunnel.

The impeller shaft 72 supports the impeller 84 within the impeller housing 82 of the unit 76. The aft end of the impeller shaft 72 is suitably supported and journalled within the compression chamber of the assembly in a known manner. The impeller shaft 72 extends in the forward direction through the bulkhead 68 of the tunnel 48. A steering nozzle 88 is supported at the downstream end of the discharge nozzle 86 for effecting directional changes of the watercraft 10 in a known manner.

As described above, the steering nozzle 88 is mounted for movement in a vertical plane about at least one pin in the horizontal axis. In addition, however, the nozzle 88 must be simultaneously mounted to as to move with respect to that pin in the horizontal axis. This may be accomplished by positioning the pin in a mounting slot provided in the nozzle, or via another similar mounting known to those skilled in the art.

As best seen in FIGS. 3, 4, 5 and 6, a ride plate 90 substantially covers the aft section 52 of the tunnel behind the water intake duct opening 80 to enclose the jet propulsion device assembly 74 and the discharge nozzle 86. In this manner, the lower opening of the tunnel aft section 52 is closed to provide a planing surface for the watercraft 10. Bolts 92 secure the ride plate 90 to the hull lower 16 with the ride plate blending with the rear incline sections of the hull 14.

The ride plate 90 includes an aperture 94 formed near its front edge 96, proximate to the front wall 58 of the tunnel aft section 52. In the illustrated embodiment, the aperture 94 is a slot that extends into the ride plate from the front edge 96; it is understood, however, that the aperture 94 can be a hole (of any shape) defined entirely within the boundary of the ride plate's periphery. For example, the aperture can be a rectangular shaped hole formed adjacent to and just behind the leading edge 96 such that a portion of the ride plate 90 lies between the leading edge and the aperture.

It should be noted that the ride plate 90 is spaced apart from the rear edge of the step 54 so as to define an air gap 98, which communicates with the tunnel 48, as best shown in FIG. 4. Also, it should be noted that the ride plate 90 is somewhat higher than the step 54. When the watercraft is traveling at speed, air will be drawn by the Venturi action caused by the step 54 from the tunnel 48 and mixed with the water, as shown by the arrows 100 in FIG. 4. This has the effect of reducing the drag on the rear portion of the hull, and hence improves the performance of the watercraft.

The ride plate 90 is preferably shaped to conform to the hull 14 of the watercraft 10. The ride plate 90 includes a base plate 102 and two side plates 104 inclined to form with the hull 14 of the watercraft. The side plates 104 are roughly symmetric in shape relative to the longitudinal center line of the hull. The side plates 104 include bosses 106 to mount the ride plate to the hull 14. In the preferred embodiment, the bosses 106 comprise through holes 108 to accept bolts 92 that are mounted into internally threaded holes in the hull 14 (not shown).

Further to enhance the maneuverability of the watercraft 10, the base plate 102 of the ride plate 90 preferably comprises grooves 108 of continuous cross section to run the entire length of the ride plate 90. The grooves 108 further comprise lateral edges 110. The grooves 108 and edges 110 contact the water and thus provide reaction forces for maneuvering the watercraft 10 during turns or cornering maneuvers. By locating the grooves 108 on the ride plate 90 the responsiveness of the watercraft 10 is increased. In particular, the turning radius of the watercraft 10 is greatly enhanced because of the proximity of the grooves 108 to the steering nozzle 88.

In order to effectively provide reaction forces, however, the water that the watercraft 10 is riding on must be free of turbulence. Typically, the majority of turbulence in the water is caused by disruption in the flow of water under the watercraft 10 by the water entering the water intake duct 78 through the water intake duct opening 80. Therefore, the turbulent water will be present behind the lateral distance across the water intake duct opening 80. The turbulent region is defined as 112.

To ensure that the ride plate 90 will be able to turn, the location of the grooves 108 in non turbulent water is critical. Thus, the grooves are located so that the distance between the outermost lateral edges 110, defined as 114, is greater than the lateral distance across the water intake duct opening 80, defined as 112. In this configuration, the turbulence created by the water intake duct opening 80 will not affect the water at the lateral edges 110 of the grooves of the ride plate 90. Therefore, the ride plate 90 will always contact at least a portion of non turbulent water ensuring increased handling.

Typically, the ride plate 90 is made of a light weight material such as aluminum alloy. In order to increase the strength of the ride plate 90, however, reinforcement ribs 116 are added. These reinforcement ribs are located laterally across the ride plate 90 and sufficiently strengthen the ride plate 90 while not substantially increasing the weight.

FIGS. 1, 2, 7, 8, 9, and 10 illustrate an exhaust system 118 provided to discharge exhaust byproducts from the engine 70 to the atmosphere and/or to the body of water in which the watercraft 10 is operated. The exhaust system 118 includes an exhaust manifold that is affixed to the side of the cylinder block and which receives exhaust gases from the variable-volume chambers through exhaust ports in a well-known manner.

An outlet end of the exhaust manifold communicates with a C-shaped pipe section 120. This C-pipe 120 includes an inner tube that communicates directly with the discharge end of the exhaust manifold (not shown). An outer tube surrounds the inner tube to form a coolant jacket between the inner and outer tubes. Although not illustrated, the C-pipe 120 includes an inlet port positioned near its inlet end. The inlet port communicates with a water jacket of the engine.

The outlet end of the C-pipe 120 communicates with an expansion chamber 122. In the illustrated embodiment, the expansion chamber 122 has a tubular shape in which an expansion volume is defined within an annular, thick wall. Coolant jacket passages extend through the expansion chamber wall and communicate with the coolant jacket of the C-pipe 120.

A flexible coupling connects the outlet end of the C-pipe 120 to the inlet end of the expansion chamber 122. The flexible coupling also can include an outlet port which communicates with an internal coolant passage within the flexible coupling. The coolant passage places the coolant jacket and the coolant passages in communication.

The outlet end of the expansion chamber 122 is fixed to a reducer pipe 124 which tapers in diameter toward its outlet. The pipe 124 has a dual shell construction formed by an inner shell which defines an exhaust flow passage. The expansion volume communicates with this passage.

An outer shell is connected to the inner shell and defines a cooling jacket about the inner shell of the reducer pipe 124. The coolant jacket passages of the expansion chamber communicate with the coolant jacket of the pipe to discharge a portion of the coolant with the exhaust gases.

A catalytic device can be disposed within the space defined at the mating ends of the expansion chamber 122 and the reducer pipe 124. For instance, the catalytic device can include an annular shell supporting a honeycomb-type catalyst bed. The catalyst bed is formed of a suitable catalytic material such as that designed to treat and render harmless hydrocarbons, carbon monoxide, and oxides of nitrogen. An annular flange supports the annular shell generally at the center of the flow path through the expansion chamber volume. In this manner, all exhaust gas flow through the expansion chamber passes through the catalyst bed. The annular flange can be held between the outlet end of the expansion chamber 122 and the inlet end of the reducer pipe 124.

The lower section of the reducer pipe 124 includes a downward turned portion that terminates at the discharge end. The inner shell stops short of the outer shell such that the water flow through the water jacket merges with the exhaust gas flow through the exhaust passage at the discharge end.

A flexible pipe 126 is connected to the discharge end of the reducer pipe 124 and extends rearward along one side of the watercraft hull tunnel 48. The flexible conduit 126 connects to an inlet section of a water trap device 128. The water trap device 128 also lies within the watercraft hull 14 on the same side of the tunnel. A rubber boot 129 is connected to the flexible conduit 126 and to the bulkhead 68 to prevent water from the aft section of the tunnel 52 from entering the engine compartment 66 shown in FIG. 7 and FIG. 8. In order to discharge any water from engine compartment 66, a bilge system pumps water through a drain mechanism 130 and water exits through a port 132.

The water trap device 128 has a sufficient volume to retain water and to preclude the back flow of water to the expansion chamber 122 and the engine 70. Internal baffles within the water trap device 128 help control water flow through the exhaust system 118.

Figure 9:
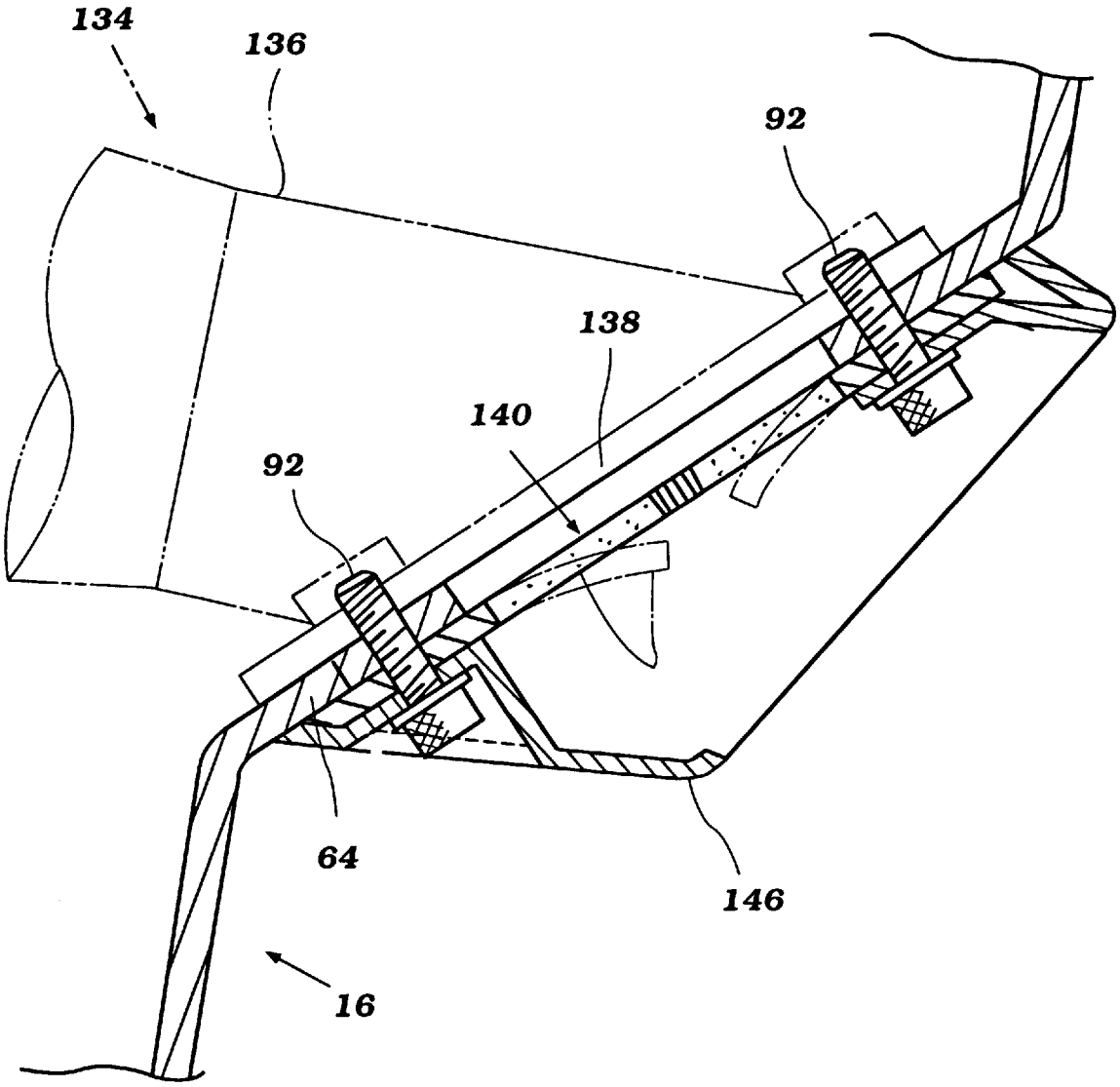
FIG. 9 is a partial cross-sectional view of the transom of the personal watercraft of FIG. 3 taken along the line E—E.

An exhaust pipe 134 extends from an outlet section of the water trap device 128 and wraps over the top of the tunnel aft section 52 to a discharge pipe 136 as shown in FIG. 9. As described in detail above, exhaust is routed from the engine 70 through the exhaust system 118 to the exhaust pipe 134. This exhaust pipe 134 is connected to a discharge pipe 136 mounted at the stern of the watercraft 10. The discharge pipe is connected to a mounting plate 138 for mounting to the hull 14 of the watercraft 10 with a plurality of bolts 92.

Figure 10:
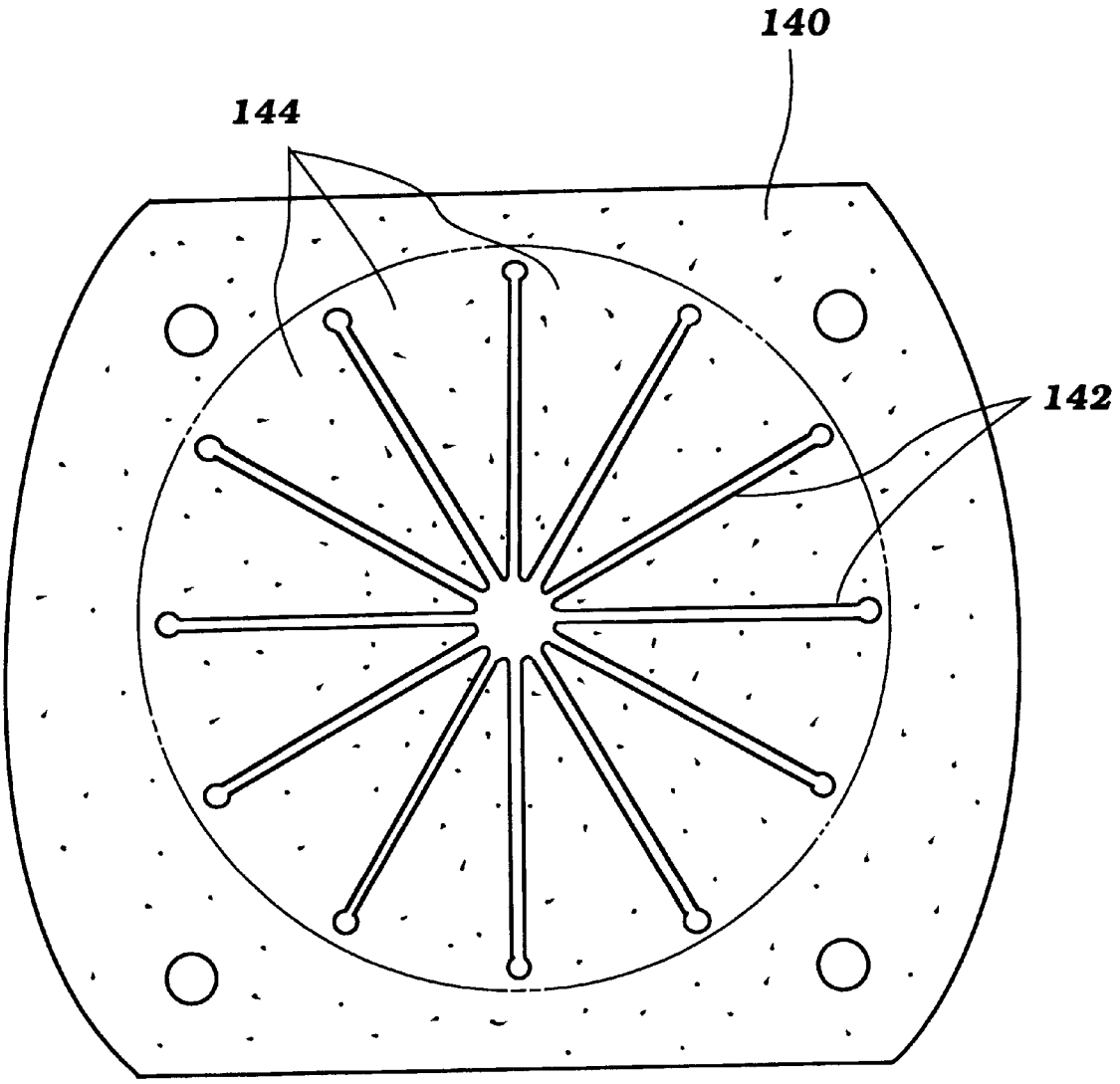
FIG. 10 is a top plan view of the exhaust discharge valve of FIG. 9.

An exhaust valve 140 is connected on the opposing side of the transom 64 from the mounting plate 138. The exhaust valve 140 is preferably made of a resilient rubber material and is best shown in FIG. 10. The valve 140 is comprised of slits 142 forming several flexible wedges 144 defined by edges 142. When the exhaust gas exits the valve 140, the wedges 144 bend creating a larger orifice as shown in FIG. 9. When there is not enough exhaust gas flowing through the valve 140 to bend the wedges 144, the valve will only provide a small orifice, thus preventing the entry of water into the exhaust system. The valve 140 is secured to the transom by the exhaust valve shield 146.

Figure 11:
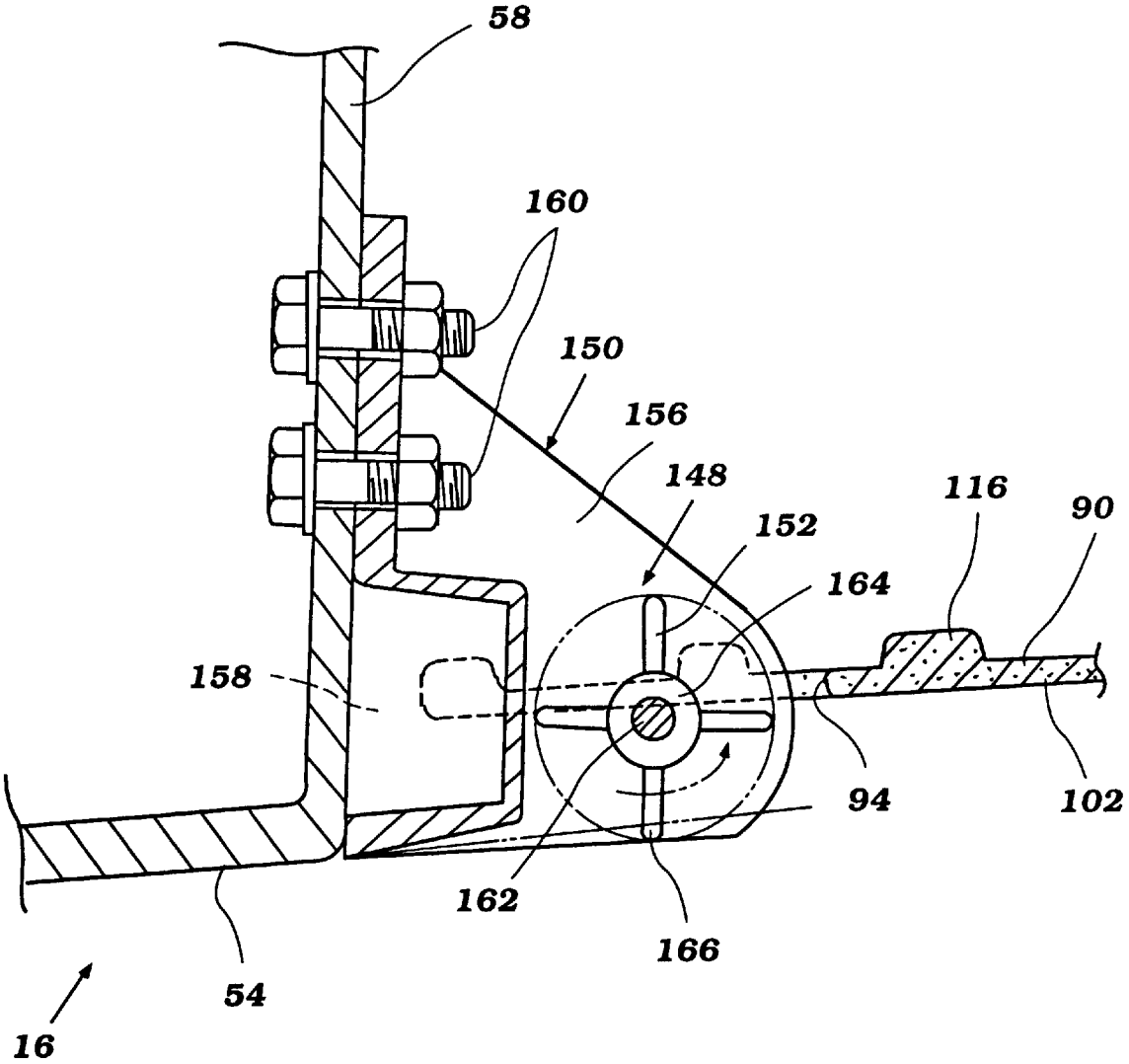
FIG. 11 is a partial cross-sectional view of the personal watercraft of FIG. 3, taken along the line F—F.
Figure 12:
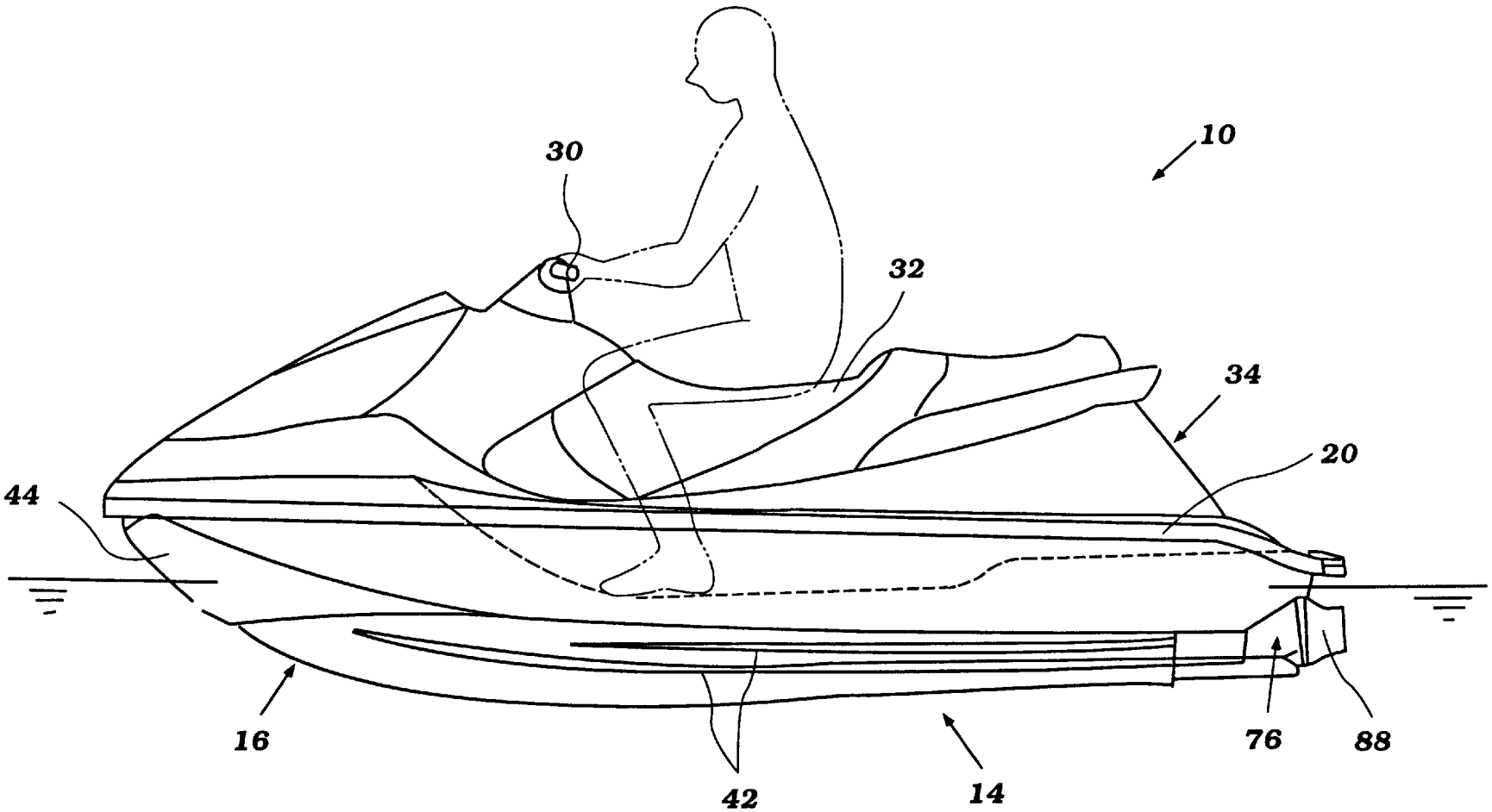
FIG. 12 is the side view of the personal watercraft of FIG. 1 showing the strakes of the hull.
Figure 13:
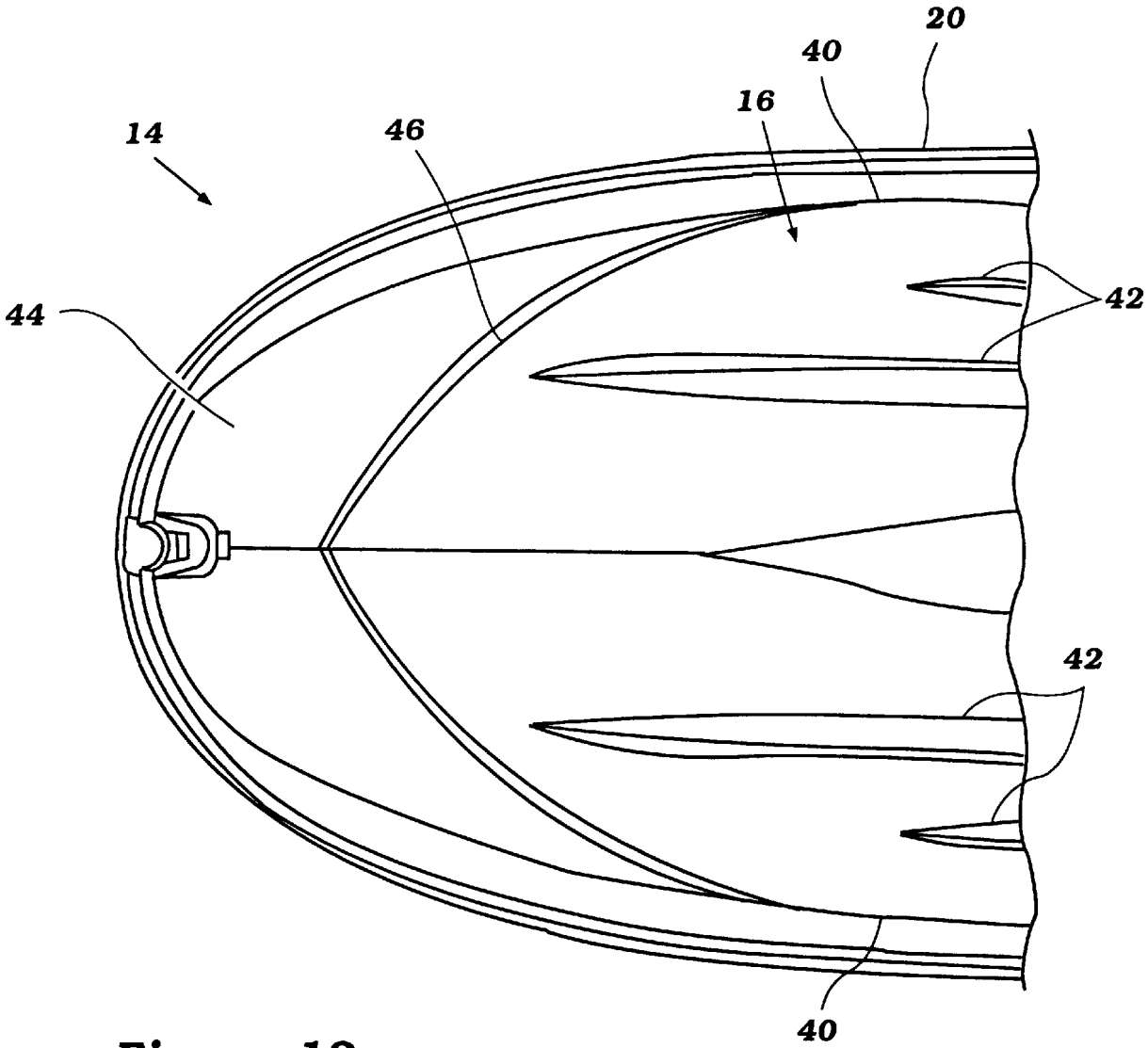
FIG. 13 is a partial bottom view of the hull of the personal watercraft of FIG. 12.
Figure 14:
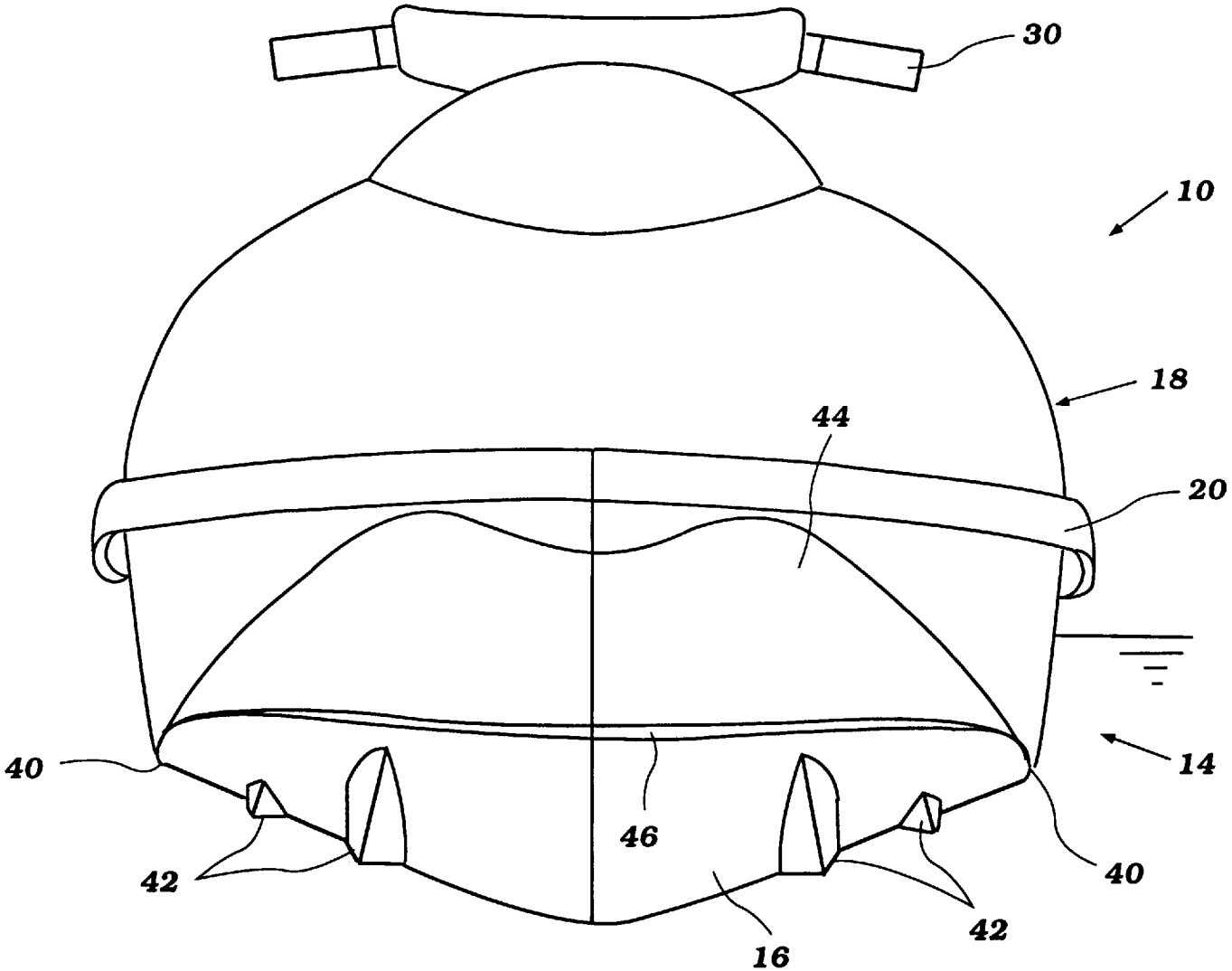
FIG. 14 is a front view of the personal watercraft of FIG. 12.

With reference to FIG. 3 and FIG. 11, a speed sensor 148 is used to determine the speed of the watercraft 10. The speed sensor 148 communicates with the display controller (and possibly an intermediate processor) to display the sensed speed on the visual display not shown. The speed sensor 148 includes a housing 150 that houses a paddle wheel 152. The housing 150 includes a pair of side lugs 154 that extend from a base plate 156. An enclosure 158 also extends outward from the base plate 156 at a position between the lugs 154. The enclosure 158 is open on the opposite side of the base plate 156. The base plate 156 also includes a plurality of through holes located above the enclosure 158 for attachment with mechanical fasteners.

A shaft 162 extends between and is supported by the lugs 154. The shaft 162 desirably lies generally parallel to the base plate 156 and is positioned toward the outer ends of the lugs 154 directly behind the enclosure 158. In the illustrated embodiment, the shaft 162 is fixed to the lugs 154; however, the shaft 162 can be suitably journalled to permit rotation of the shaft 162 relative to the lugs 154.

The shaft 162 supports the paddle wheel 152 at a location between the lugs 154. The paddle wheel 152 desirably is suitably journalled to rotate about the shaft 162. For this purpose, the paddle wheel includes a bushing hub 164 that rotates on the shaft 162. The hub 164, however, is desirably maintained in a generally constant axial position on the shaft 162 by known means.

The speed sensor 148 also includes a rotation detector (not shown) that is used to determine the rotational speed of the paddle wheel 152. In a preferred embodiment, the rotational detector includes a Hall-effect transducer that cooperates with the blades 166 of the paddle wheel 152. For this purpose, the blades 166 of the paddle wheel 152 desirably are made of a magnetic material and are alternately polarized. The paddle wheel 152 therefore includes an even number of blades 166. The exemplary embodiment shown in FIG. 11 includes four blades 166 with the blades that are positioned on diametrically opposite sides of the hub having the same polarity (schematically illustrated by the N and S corresponding to magnetic poles).

The Hall-effect transducer is enclosed between the enclosure 158 and the front wall 48 when the sensor is mounted on the front wall 48. A plurality of fasteners secure the sensor at this location. The transducer produces a signal which can then be used to determine the speed of the watercraft 10. The signal is communicated to either the visual controller or to an intermediate processor via conventional means.

Figure 5:
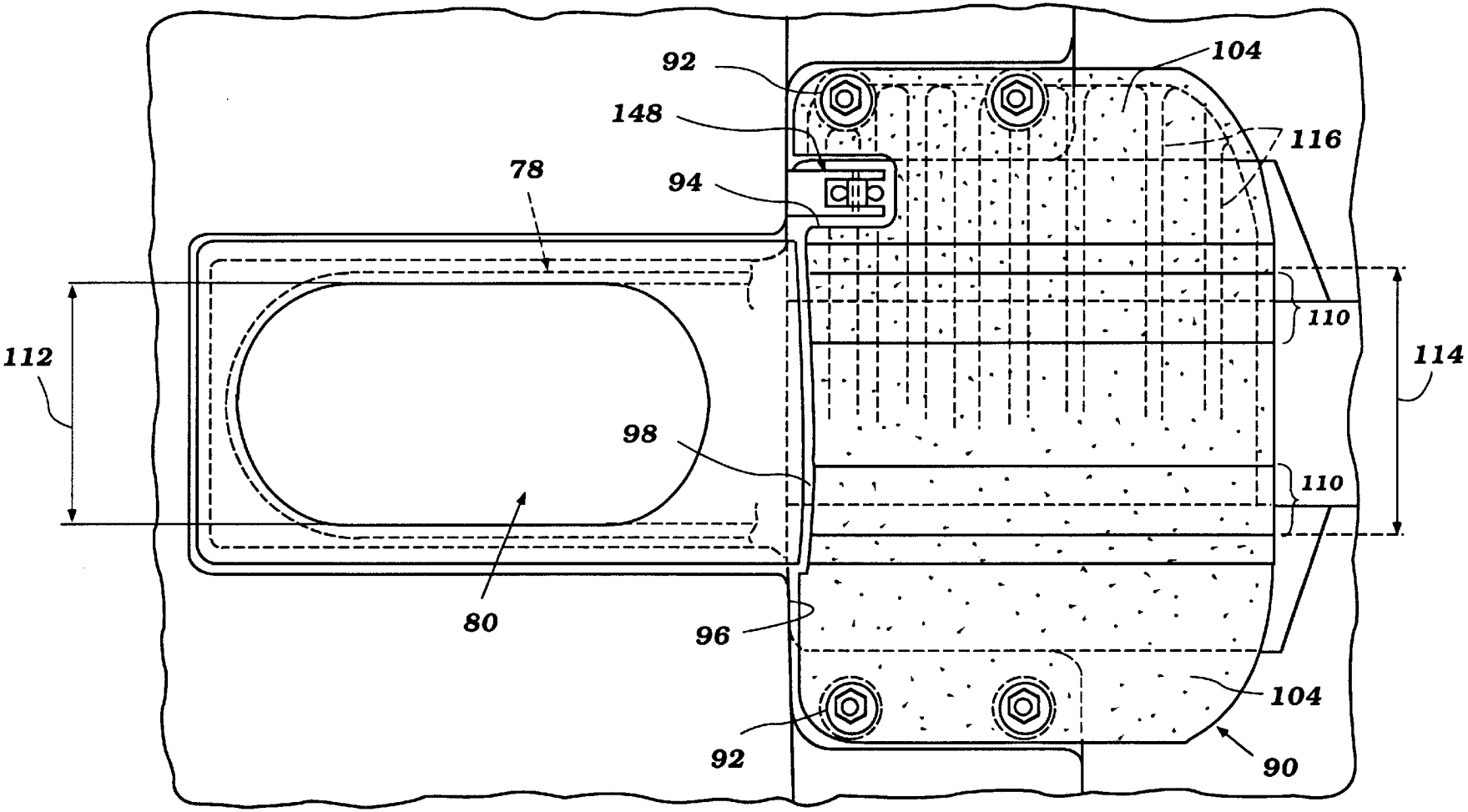
FIG. 5 is a partial bottom view of a hull of the personal watercraft of FIG. 1 near the stern of the watercraft.
Figure 6:
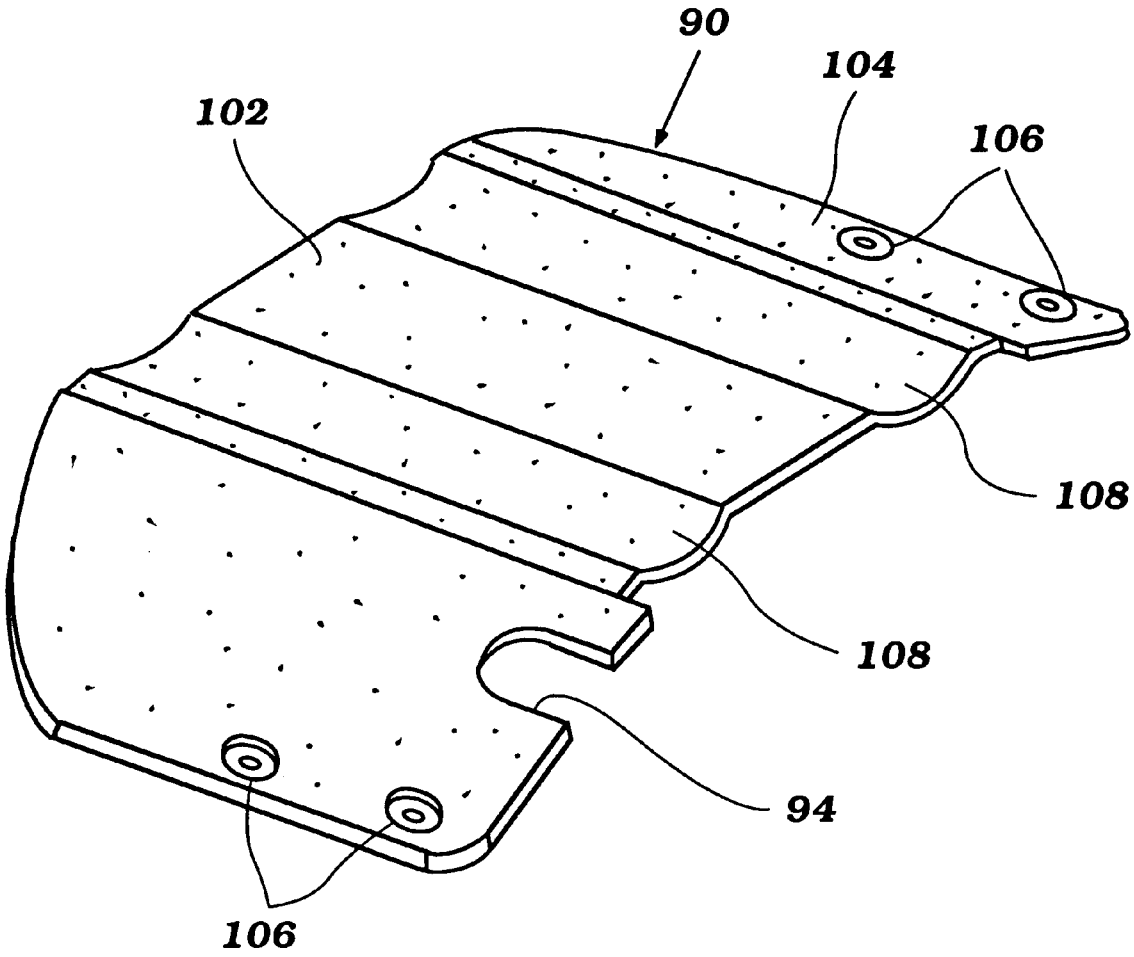
FIG. 6 is a perspective view of the ride-plate.
Figure 7:
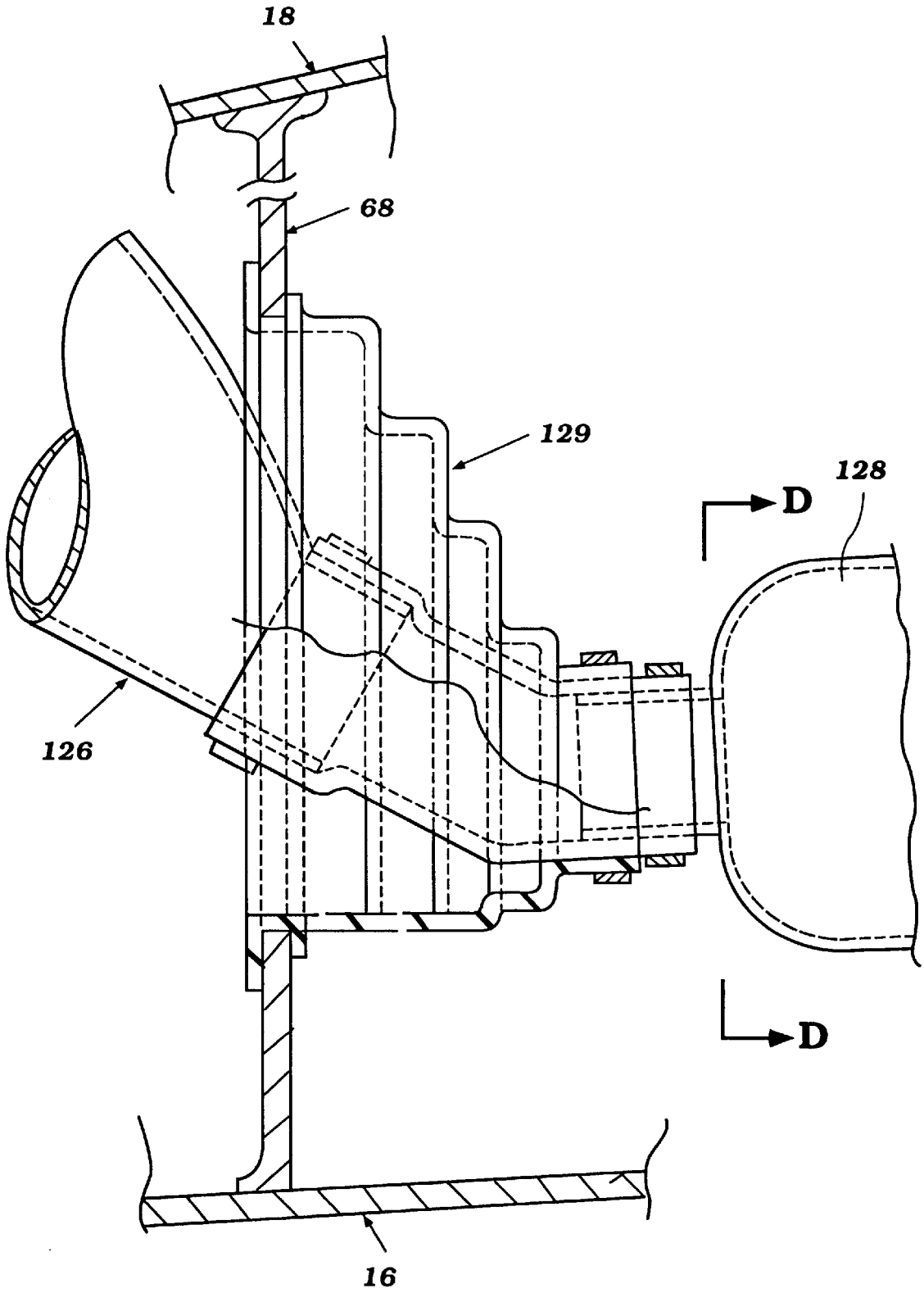
FIG. 7 is a partial cross section of the personal watercraft of FIG. 2, taken along the line C—C.
Figure 8:
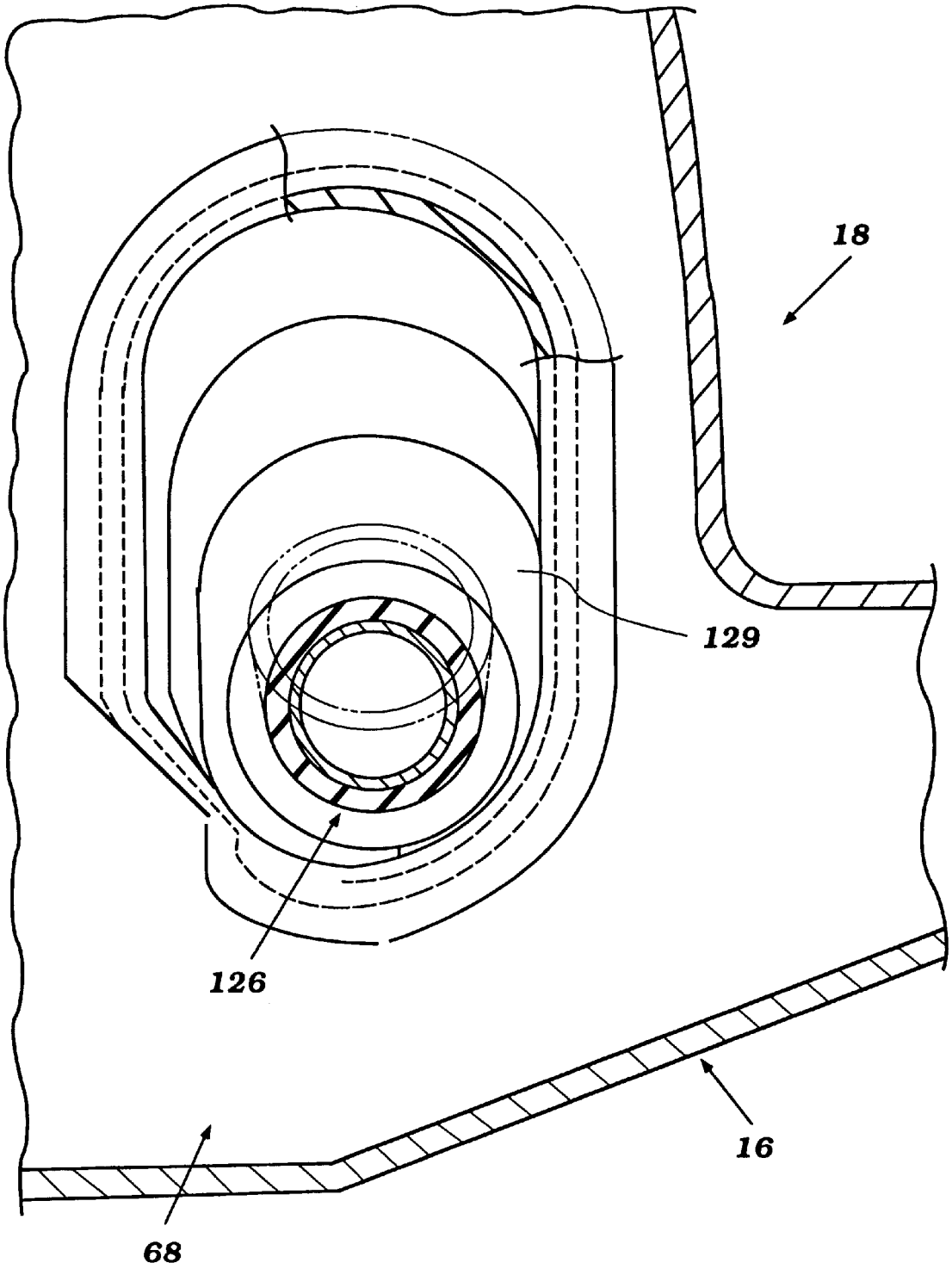
FIG. 8 is a partial cross section of the exhaust system of FIG. 7 taken along the line D—D.

The speed sensor 148 is mounted to the front wall 58 of the tunnel 52 and desirably lies to a side of the jet propulsion unit 76 opposite of the steering lever (not shown) and associated cables. In this position, as best seen in FIGS. 3, 5 and 11, at least a portion of the lower end of the housing 150 that includes the paddle wheel 152 fits within the aperture 94 formed in the ride plate 90. In this position, the tip of the blades 166 do not extend below the profile of the hull 14 off to one side of the jet propulsion unit 76 and well behind the transom 64. The speed sensor 148 is not readily seen from the rear side of the watercraft 10 and does not interfere with the operation or arrangement of the steering and trim adjustment mechanisms in this position. The signal wires from the Hall-effect transducer are also easily routed through the front wall 58 to the watercraft control electronics. In addition, the speed sensor 148 lies directly behind the step 42 formed on the underside of the hull 14 which helps to protect the speed sensor 148. The position of the speed sensor 148 on the front wall 58 of the tunnel 52 thus simplifies the arrangement of the speed sensor 148, as well as affords additional protection for the speed sensor (or probe) 148.

Although this invention has been described in terms of a certain preferred embodiment, other embodiments apparent to those of ordinary skill in the art are also within the scope of this invention. Accordingly, the scope of the invention is intended to be defined only by the claims that follow.

What is claimed is:

1. A watercraft comprising a hull with an undersurface defining a tunnel at the rear end thereof and a longitudinal axis extending in a forward direction toward a bow of the watercraft and in a rearward direction toward a stern of the watercraft, a jet propulsion unit positioned at least in part within said tunnel for propelling said watercraft, a water intake duct communicating with said jet propulsion unit said water intake duct comprising an intake duct opening to receive water into said water intake duct, said intake opening comprising two sides and said intake duct opening being located forward of said ride plate, said jet propulsion unit having a discharge nozzle formed at the rear end thereof through which water is discharged for propelling said watercraft, a ride plate attached to the underside of said hull, the ride plate comprising a base plate located at least partially beneath said jet propulsion unit and at least two inclined side plates, said ride plate further comprising at least two continuous grooves extending from a forward most portion of the base plate to a rearward most portion of the base plate, each groove being defined between a pair of lateral edges formed on the underside of said base plate, and each groove being located on said base plate so at least one lateral edge of each groove is located farther from said longitudinal axis of said hull than one of said sides of said water intake duct opening which is adjacent to said edge.

2. The watercraft of claim 1, wherein each groove has a uniform cross section along the length of said groove.

3. The watercraft of claim 1, wherein said ride plate spans across at least a rearward portion of said tunnel for closing at least a portion of said tunnel.

4. The watercraft of claim 1, wherein said ride plate comprises a slot in said ride plate sized to receive a speed probe integral with said ride plate.

5. The watercraft of claim 1, wherein said ride plate comprises laterally extending ribs.

6. The watercraft of claim 1, wherein each groove is located on said ride plate so at least one lateral edge of said groove is located closer to said longitudinal axis of said hull than one of said sides of said water intake duct opening which is adjacent to said edge.

7. A watercraft comprising a hull with an undersurface defining a tunnel at the rear end thereof, said undersurface of said hull further comprising a longitudinal axis located at the center of said undersurface of said hull, said longitudinal axis extending in a forward direction toward a bow of the watercraft and in a rearward direction toward a stem of the watercraft, a water intake duct communicating with a jet propulsion unit, said water intake duct comprising an intake duct opening for water to enter said water intake duct, said intake duct opening being located forward of said ride plate, said jet propulsion unit positioned at least in part within said tunnel for propelling said watercraft, said jet propulsion unit having a discharge nozzle formed at the rear end thereof through which water is discharged for propelling said watercraft, a ride plate attached to the underside of said hull and located at least partially beneath said jet propulsion unit, said ride plate further comprising at least two grooves formed on the underside of said ride plate, each of said grooves comprising at least two lateral edges, with one of said edges being located on said ride plate at a distance farther from said longitudinal axis than an adjacent edge of said intake duct opening in a laterally outward direction from said longitudinal axis. and with the other one of said edges being located on said ride plate at a distance closer to said longitudinal axis than an adjacent edge of said intake duct opening in a laterally outward direction from said longitudinal axis.

8. The watercraft of claim 7, wherein each of said grooves have a continuous shape.

9. The watercraft of claim 7, wherein said grooves extend from the forward most portion of the ride plate to the rearward most portion of the ride plate.

10. The watercraft of claim 7, wherein the one lateral edge of each groove, which is farthest from said longitudinal axis, is an outer edge, and the other lateral edge, which is closest to the longitudinal axis, is an inner edge, and wherein a maximum distance between the outer edges of the grooves is greater than a maximum lateral width of the intake duct opening measured normal to said longitudinal axis.

11. The watercraft of claim 10, wherein a minimum distance between the inner edges of the grooves is less than a minimum lateral width of said intake duct opening as measured along said hull in a direction normal to said longitudinal axis.

12. The watercraft of claim 7, wherein said ride plate comprises a slot in said ride plate sized to receive a speed probe integral with said ride plate.

13. The watercraft of claim 7, wherein said ride plate further comprises laterally extending ribs.

14. The watercraft of claim 7, wherein said water intake duct is formed apart from said hull.

15. The watercraft of claim 7, wherein said water intake duct is integrally formed in said hull.

16. A watercraft comprised of a hull with an undersurface defining a tunnel at the rear end thereof, said undersurface of said hull including a water intake duct opening for water to enter a water intake duct, said water intake duct communicating with a jet propulsion unit positioned at least in part within said tunnel for propelling said watercraft, said jet propulsion unit having a discharge nozzle formed at the rear end thereof through which water is discharged for propelling said watercraft, a ride plate attached to the underside of said hull located at least partially beneath said jet propulsion unit, said ride plate further comprising watercraft performance enhancement means for improving the performance of the watercraft, said performance enhancement means comprising at least two longitudinally extending grooves that extend continuously from a forward most portion of the ride plate to a rearward most portion of the ride plate, each groove having two longitudinal edges being arranged on the ride plate such that all edges remain in contact with the body of water in which the watercraft is operated when the watercraft is up on plane, and the longitudinal edges being arranged such that at least two of the edges contact water behind the duct opening and at least two of the edges contact water flowing past a side of the duct opening.

17. A ride plate for a watercraft comprising a front end and a rear end and at least two continuous grooves extending from said front end of said ride plate to said rear end of said ride plate, each groove being defined between a pair of opposing edges formed on the lower side of said ride plate, and at least one boss configured to cooperate with a portion of a hull undersurface of the watercraft for mounting said ride plate to said watercraft, a cross-section of each groove being uniform along a length of each groove from said front end of said ride plate to said rear end of said ride plate.

18. The ride plate of claim 17, wherein said opposing edges are parallel.

19. The ride plate of claim 17, wherein said ride plate further comprises a base and two sides, each side is attached to said base at an inclined angles and said grooves are located on the lower side of said base.

20. The ride plate of claim 17, wherein(said sides) further comprise mounting bosses to mount said ride plate to said watercraft.

21. The ride plate of claim 17, wherein said ride plate comprises a slot in said ride plate sized to receive a speed probe integral with said ride plate.

22. The ride plate of claim 17, wherein said ride plate further comprises laterally extending ribs.

* * * * *

UNITED STATES PATENT AND TRADEMARK OFFICE

CERTIFICATE OF CORRECTION

PATENT NO. : 6,101,965
DATED : August 15, 2000
INVENTOR(S) : Tomoyoshi Koyanagi

It is certified that error appears in the above-identified patent and that said Letters Patent is hereby corrected as shown below:

Column 11,
Line 16, please change “a stem” to -- a stern --

Signed and Sealed this

Fourth Day of June, 2002

*Attest:*

*Attesting Officer*

JAMES E. ROGAN
*Director of the United States Patent and Trademark Office*